US011591896B2

(12) United States Patent
Liu

(10) Patent No.: US 11,591,896 B2
(45) Date of Patent: Feb. 28, 2023

(54) EFFICIENT AND INTELLIGENT STEERING DRILLING SYSTEM AND DRILLING METHOD

(71) Applicant: CHINA UNIVERSITY OF PETROLEUM (EAST CHINA), Qingdao (CN)

(72) Inventor: Yongwang Liu, Qingdao (CN)

(73) Assignee: CHINA UNIVERSITY OF PETROLEUM (EAST CHINA), Qingdao (CN)

( * ) Notice: Subject to any disclaimer, the term of this patent is extended or adjusted under 35 U.S.C. 154(b) by 0 days.

(21) Appl. No.: 17/777,111

(22) PCT Filed: Mar. 9, 2021

(86) PCT No.: PCT/CN2021/079617

§ 371 (c)(1),
(2) Date: May 16, 2022

(87) PCT Pub. No.: WO2022/041679

PCT Pub. Date: Mar. 3, 2022

(65) Prior Publication Data

US 2022/0412203 A1 Dec. 29, 2022

(30) Foreign Application Priority Data

Aug. 31, 2020 (CN) ..... 202010891635.0

(51) Int. Cl.
*E21B 17/10* (2006.01)
*E21B 47/022* (2012.01)
(Continued)

(52) U.S. Cl.
CPC ..... *E21B 44/00* (2013.01); *E21B 7/067* (2013.01); *E21B 17/1078* (2013.01); *E21B 47/022* (2013.01)

(58) Field of Classification Search
CPC ..... E21B 44/00; E21B 7/067; E21B 17/1078; E21B 7/06; E21B 47/022
See application file for complete search history.

(56) References Cited

U.S. PATENT DOCUMENTS

2015/0330150 A1* 11/2015 Strachan ..... E21B 7/20 175/45
2016/0108679 A1* 4/2016 Bayliss ..... E21B 7/06 175/45
(Continued)

FOREIGN PATENT DOCUMENTS

CN 2773297 Y 4/2006
CN 102278065 A * 12/2011
(Continued)

OTHER PUBLICATIONS

First Search Report issued in corresponding Chinese Application No. 2020108916350; dated Apr. 30, 2021; 5 pgs.
(Continued)

*Primary Examiner* — Daniel P Stephenson
(74) *Attorney, Agent, or Firm* — Hauptman Ham, LLP

(57) ABSTRACT

A high efficiency smart steering drilling system includes a smart push force application tool and a centralizer. The centralizer is at an end close to a drill bit. The smart push force application tool is at an end away from the drill bit and includes a push force application wing rib having a telescoping function. The smart push force application tool is capable of automatically measuring an inclination angle and an azimuth angle and comparing the inclination angle and the azimuth angle with design values so as to control the push force application wing rib to output a push force in a telescopic manner based on a difference between the measured values and the design values and applying a push force to the drill bit. The drilling system achieves combined
(Continued)

deflection under double action of drill bit push and pointing, greatly improving the deflection capability.

7 Claims, 1 Drawing Sheet

(51) Int. Cl.

| | |
|---|---|
| ***E21B 7/00*** | (2006.01) |
| ***E21B 44/00*** | (2006.01) |
| ***E21B 7/06*** | (2006.01) |

(56) References Cited

U.S. PATENT DOCUMENTS

| | | | | |
|---|---|---|---|---|
| 2019/0301244 | A1* | 10/2019 | Moore | E21B 47/024 |
| 2021/0040796 | A1* | 2/2021 | Azar | E21B 47/26 |
| 2022/0316279 | A1* | 10/2022 | Wan | E21B 47/022 |

FOREIGN PATENT DOCUMENTS

| | | | | |
|---|---|---|---|---|
| CN | 202689930 | U | 1/2013 | |
| CN | 112145071 | A | 12/2020 | |
| WO | WO-2020018816 | A1 * | 1/2020 | |
| WO | WO-2022041679 | A1 * | 3/2022 | E21B 17/1078 |
| WO | WO-2022083602 | A1 * | 4/2022 | E21B 17/20 |

OTHER PUBLICATIONS

First Office Action issued in corresponding Chinese Application No. 2020108916350; dated May 28, 2021; 18 pgs.
Second Office Action issued in corresponding Chinese Application No. 2020108916350; dated Aug. 5, 2021; 19 pgs.
Third Office Action issued in corresponding Chinese Application No. 2020108916350; dated Oct. 29, 2021; 7 pgs.
Notification to Grant issued in corresponding Chinese Application No. 2020108916350; dated Jan. 12, 2022; 4 pgs.
International Search Report and Written Opinion issued in International Application No. PCT/CN2021/079617; dated May 28, 2021; 16 pgs.

* cited by examiner

EFFICIENT AND INTELLIGENT STEERING DRILLING SYSTEM AND DRILLING METHOD

RELATED APPLICATIONS

The present application is a U.S. National Phase of International Application Number PCT/CN2021/079617 filed Mar. 9, 2021, and claims priority to Chinese Application Number 2020108916350 filed Aug. 31, 2020.

TECHNICAL FIELD

The present invention relates to the field of petroleum engineering, and in particular to a high efficiency smart steering drilling system and a drilling method thereof.

BACKGROUND

How to enable a borehole to extend quickly and accurately along a designed track in a deep drilling process has become an important research topic in the drilling engineering field. A steering drilling system provides a guarantee for a borehole to extend quickly and accurately along a designed track. At present, there are two types of steering drilling systems and methods: (1) slide steering drilling system; and (2) rotary steering drilling system, where the rotary steering drilling system performs rotary drilling in the full process of trajectory control, lowering the difficulty of trajectory control and increasing the drilling speed. Thus, engineering personnel and on-site persons prefer it. However, there are still several problems with the rotary steering drilling technology to be studied and solved. The main problems are as follows: (1) the deflection capability of the steering drilling system is to be further improved; (2) the drilling life of the steering drilling system in a complex formation is still relatively short; (3) the drilling speed of the rotary steering drilling system has not have acceleration space; (4) the use effect of the steering drilling system is contradictory to near-bit measurement. Therefore, development of a steering drilling system with strong deflection capability, long working life and high rock-breaking speed is of great value for advancement of drilling technology as well as of great significance for high efficiency development of oil and gas resources. For this purpose, the present invention provides a high efficiency smart steering drilling system and a drilling method thereof. The drilling system has a strong deflection capability, long working life and high rock-breaking speed and thus can effectively solve the above technical problems of the existing drilling systems.

SUMMARY

In order to overcome the above defects existing in the prior arts, the present invention provides a high efficiency smart steering drilling system and a drilling method thereof. The drilling system has a strong deflection capability, long working life and high rock-breaking speed.

Provided is a high efficiency smart steering drilling system. The steering drilling system is provided with a smart push force application tool and a centralizer. The centralizer is disposed at an end close to a drill bit and the smart push force application tool is disposed at an end away from the drill bit and further provided with a push force application wing rib having a telescoping function. The smart push force application tool is capable of automatically measuring an inclination angle and an azimuth angle and comparing the inclination angle and the azimuth angle with design values so as to control the push force application wing rib to output a push force in a telescopic manner based on a difference between the measured values and the design values and thus achieve the objective of applying a push force to the drill bit; in a case of needing to increase the inclination angle, the push force application wing rib applies a downward push force; in a case of needing to decrease the inclination angle, the push force application wing rib applies an upward push force; in a case of needing to increase the azimuth angle, the push force application wing rib applies a counterclockwise push force; in a case of needing to decrease the azimuth angle, the push force application wing rib applies a clockwise push force.

Furthermore, on the smart push force application tool is provided with a flexible joint and an upper drill assembly, and the upper drill assembly, the flexible joint and the smart push force application tool are connected in sequence.

Furthermore, a drilling acceleration tool, a near-bit drilling collar and a near-bit measurement sub, or any two of the drilling acceleration tool, the near-bit drilling collar and the near-bit measurement sub, or any one of the drilling acceleration tool, the near-bit drilling collar and the near-bit measurement sub is disposed between the smart push force application tool and the centralizer.

Furthermore, the centralizer is integrated to a component immediately close to the drill bit.

Furthermore, the centralizer is an ordinary down-hole packed-hole centralizer or a rotary shell centralizer.

Furthermore, the smart push force application tool is composed of a trajectory parameter measuring module, a trajectory correcting module, a push force application control module, and a push force application wing rib. The trajectory parameter measuring module measures borehole trajectory parameters in real time, the trajectory correcting module compares the borehole trajectory parameters measured in real time with design trajectory parameters and provides a trajectory control instruction to the push force application control module, and the push force application control module receives the trajectory control instruction from the trajectory correcting module to control a push force application mode of the push force application wing rib.

Furthermore, the push force application mode of the smart push force application tool is to enable the push force application wing rib to apply a push force to a drill through wing rib telescoping: when a downward push force is desired, an upper wing rib extends out of the tool and a lower wing rib retracts into the tool; when an upward push force is desired, the lower wing rib extends out of the tool and the upper wing rib retracts into the tool; when a clockwise push force is desired, a left wing rib extends out of the tool and a right wing rib retracts into the tool; when a counterclockwise push force is desired, the right wing rib extends out of the tool and the left wing rib retracts into the tool.

Provided is a drilling method using the high efficiency smart steering drilling system. The drilling system is provided with an upper drill assembly and a flexible joint, and the upper drill assembly, the flexible joint and the smart push force application tool are connected in sequence. The drilling method includes the following steps:

at step 1, based on a trajectory control requirements, calculating a length of the flexible joint, a distance from the flexible joint to the push force application wing rib, a distance from the push force application wing rib to the centralizer and a distance from the centralizer to the drill bit;

at step 2, based on data calculated in step 1, assembling the drilling system of the present invention;

at step 3, according to a designed drilling solution, performing steering drilling operation in the following method:

the smart push force application tool is capable of automatically measuring an inclination angle and an azimuth angle and comparing the measured values with design values so as to control the push force application wing rib to output a push force based on a difference between the measured values and the design values; in a case of needing to increase the inclination angle, the smart push force application tool applies a downward push force; in a case of needing to decrease the inclination angle, the smart push force application tool applies an upward push force; in a case of needing to increase the azimuth angle, the smart push force application tool applies a counterclockwise push force; in a case of needing to decrease the azimuth angle, the smart push force application tool applies a clockwise push force.

Furthermore, the specific workflow of the smart push force application tool in step 3 is as follows: the trajectory parameter measuring module measures borehole trajectory parameters in real time and transmits the trajectory parameters to the trajectory correcting module, the trajectory correcting module compares the borehole trajectory parameters measured by trajectory parameter measuring module in real time with design trajectory parameters and sends a trajectory control instruction to the push force application control module, and the push force application control module controls a push force application mode of the push force application wing rib based on the trajectory control instruction sent by the trajectory correcting module, so that, when the trajectory correcting module sends an inclination angle increasing instruction, the push force application control module controls the push force application wing rib to apply a downward push force; when the trajectory correcting module sends an inclination angle decreasing instruction, the push force application control module controls the push force application wing rib to apply an upward push force; when the trajectory correcting module sends an azimuth angle decreasing instruction, the push force application control module controls the push force application wing rib to apply a clockwise push force; when the trajectory correcting module sends an azimuth angle increasing instruction, the push force application control module controls the push force application wing rib to apply a counter-clockwise push force; the push force application wing rib applies a push force to a drill through wing rib telescoping: when a downward push force is desired, an upper wing rib extends out of the tool and a lower wing rib retracts into the tool; when an upward push force is desired, the lower wing rib extends out of the tool and the upper wing rib retracts into the tool; when a clockwise push force is desired, a left wing rib extends out of the tool and a right wing rib retracts into the tool; when a counter-clockwise push force is desired, the right wing rib extends out of the tool and the left wing rib retracts into the tool.

The smart push force application tool includes four modules: a trajectory parameter measuring module, a trajectory correcting module, a push force application control module, and a push force application wing rib. The trajectory parameter measuring module measures borehole trajectory parameters such an inclination angle and an inclination azimuth angle in real time; the trajectory correcting module compares the borehole trajectory parameters measured in real time with design trajectory parameters and provides a trajectory control instruction. When an actually measured inclination angle is smaller than a design inclination angle, an inclination angle increasing instruction is sent, and when an actually measured inclination angle is larger than the design inclination angle, an inclination angle decreasing instruction is sent, and when an actually measured inclination angle is equal to the design inclination angle, an inclination angle stabilization instruction is sent. Furthermore, when an actually-measured inclination azimuth angle is smaller than a design inclination azimuth angle, an azimuth angle increasing instruction is sent; when an actually-measured inclination azimuth angle is larger than the design inclination azimuth angle, an azimuth angle decreasing instruction is sent; when an actually-measured inclination azimuth angle is equal to the design inclination azimuth angle, an azimuth angle stabilization instruction is sent. The push force application control module controls the push force application mode of the push force application wing rib based on the instruction sent by the trajectory correcting module. When the trajectory correcting module sends an inclination angle increasing instruction, the push force application control module controls the push force application wing rib to apply a downward push force; when the trajectory correcting module sends an inclination angle decreasing instruction, the push force application control module controls the push force application wing rib to apply an upward push force; when the trajectory correcting module sends an azimuth angle decreasing instruction, the push force application control module controls the push force application wing rib to apply a clockwise push force; when the trajectory correcting module sends an azimuth angle increasing instruction, the push force application control module controls the push force application wing rib to apply a counter-clockwise push force; the push force application wing rib applies a push force to a drill through wing rib telescoping: when a downward push force is desired, an upper wing rib extends out of the tool and a lower wing rib retracts into the tool; when an upward push force is desired, the lower wing rib extends out of the tool and the upper wing rib retracts into the tool; when a clockwise push force is desired, a left wing rib extends out of the tool and a right wing rib retracts into the tool; when a counter-clockwise push force is desired, the right wing rib extends out of the tool and the left wing rib retracts into the tool.

Beneficial Effects:

1) Combined deflection can be achieved under the double action of bit push and pointing, greatly increasing the deflection capability.

2) The push force of the drill bit can be increased, and the strength that the smart steering drilling system outputs a push force during operation is reduced, thus improving its service life.

3) An acceleration tool is mounted near the bit, achieving the objective of not affecting the operation of the smart steering drilling system during an acceleration process.

4) A near-bit measurement tool is mounted near the bit, achieving the objective of measuring parameters near the bit.

5) When the smart push force application tool does not work, the system can still have strong deflection capability, helping trajectory control.

Figure 1:
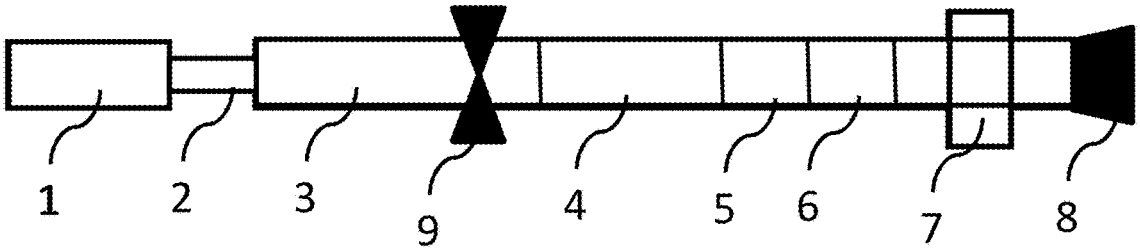
FIG. 1 is a structural schematic diagram illustrating a smart steering drilling system according to the present invention.

In the drawings, numerals are described below: 1. upper drill assembly, 2. flexible joint, 3. smart push force application tool, 4. drilling acceleration tool, 5. near-bit drilling collar, 6. near-bit measurement sub, 7. centralizer, 8. drill bit, 9. push force application wing rib, and 10. ordinary centralizer.

DETAILED DESCRIPTION OF THE EMBODIMENTS

In order to describe the objects, the technical solutions and the advantages of the present invention more clearly, the present invention will be further elaborated in combination with embodiments. It should be understood that the specific embodiments described herein are used only for explaining the present invention rather than for limiting the present invention. That is, the embodiments described herein are merely some of the present invention rather than all the embodiments of the present invention.

The present invention will be elaborated further in combination with accompanying drawings.

The present invention provides a high efficiency smart steering drilling system. The steering drilling system is provided with a smart push force application tool 3 and a centralizer 7. The centralizer 7 is disposed at an end close to a drill bit, and the smart push force application tool 3 is disposed at an end away from the drill bit and further provided with a push force application wing rib having a telescoping function. The smart push force application tool is capable of automatically measuring an inclination angle and an azimuth angle and comparing the inclination angle and the azimuth angle with design values so as to control the push force application wing rib to output a push force in a telescopic manner based on a difference between the measured values and the design values and thus achieve the objective of applying a push force to the drill bit; in a case of needing to increase the inclination angle, the push force application wing rib applies a downward push force; in a case of needing to decrease the inclination angle, the push force application wing rib applies an upward push force; in a case of needing to increase the azimuth angle, the push force application wing rib applies a counterclockwise push force; in a case of needing to decrease the azimuth angle, the push force application wing rib applies a clockwise push force.

On the smart push force application tool 3 is provided with a flexible joint 2 and an upper drill assembly 1, and the upper drill assembly 1, the flexible joint 2 and the smart push force application tool are connected in sequence.

A drilling acceleration tool 4, a near-bit drilling collar 5 and a near-bit measurement sub 6, or any two of the drilling acceleration tool 4, the near-bit drilling collar 5 and the near-bit measurement sub 6, or any one of the drilling acceleration tool 4, the near-bit drilling collar 5 and the near-bit measurement sub 6 is disposed between the smart push force application tool 3 and the centralizer 7.

The smart push force application tool is provided with a push force application wing rib 9 having telescoping function. The centralizer 7 is an ordinary down-hole packed-hole centralizer or a rotary shell centralizer.

In another combination solution of the drilling system, the centralizer 7 is integrated to a component near the drill bit.

The smart push force application tool 3 is composed of a trajectory parameter measuring module, a trajectory correcting module, a push force application control module, and a push force application wing rib 9. The trajectory parameter measuring module measures borehole trajectory parameters in real time, the trajectory correcting module compares the borehole trajectory parameters measured in real time with design trajectory parameters and provides a trajectory control instruction, and the push force application control module controls a push force application mode of the push force application wing rib based on the trajectory control instruction from the trajectory correcting module. The push force application wing rib 9 applies a push force to a drill through wing rib telescoping: when a downward push force is desired, an upper wing rib extends out of the tool and a lower wing rib retracts into the tool; when an upward push force is desired, the lower wing rib extends out of the tool and the upper wing rib retracts into the tool; when a clockwise push force is desired, a left wing rib extends out of the tool and a right wing rib retracts into the tool; when a counterclockwise push force is desired, the right wing rib extends out of the tool and the left wing rib retracts into the tool.

A length of the flexible joint 2, a distance from the flexible joint 2 to the push force application wing rib, a distance from the push force application wing rib to the centralizer and a distance from the centralizer 7 to the drill bit are to be determined through calculation.

Provided is a drilling method using the high efficiency smart steering drilling system. The drilling method includes the following steps:

At step 1, based on a trajectory control requirements, a length of the flexible joint 2, a distance from the flexible joint 2 to the push force application wing rib 9, a distance from the push force application wing rib 9 to the centralizer 7 and a distance from the centralizer to the drill bit are calculated.

At step 2, based on data calculated in step 1, the drilling system of the present invention is assembled.

At step 3, according to a designed drilling solution, steering drilling operation is performed in the following method:

the smart push force application tool is capable of automatically measuring an inclination angle and an azimuth angle and comparing the measured values with design values so as to control the push force application wing rib to output a push force based on a difference between the measured values and the design values; in a case of needing to increase the inclination angle, the smart push force application tool applies a downward push force; in a case of needing to decrease the inclination angle, the smart push force application tool applies an upward push force; in a case of needing to increase the azimuth angle, the smart push force application tool applies a counterclockwise push force; in a case of needing to decrease the azimuth angle, the smart push force application tool applies a clockwise push force.

In the smart push force application tool, the trajectory parameter measuring module measures borehole trajectory parameters in real time and transmits the trajectory parameters to the trajectory correcting module, the trajectory correcting module compares the borehole trajectory parameters measured by trajectory parameter measuring module in real time with design trajectory parameters and sends a trajectory control instruction, and the push force application control module controls a push force application mode of the push force application wing rib based on the trajectory control instruction sent by the trajectory correcting module, so that, when the trajectory correcting module sends an inclination angle increasing instruction, the push force application control module controls the push force application wing rib to apply a downward push force; when the trajectory correcting module sends an inclination angle decreasing instruction, the push force application control module controls the push force application wing rib to apply an upward push force; when the trajectory correcting module sends an azimuth angle decreasing instruction, the push force application control module controls the push force application wing rib to apply a clockwise push force; when the trajectory correcting module sends an azimuth angle increasing instruction, the push force application control module controls the push force application wing rib to apply a counter-clockwise push force; the push force application wing rib applies a push force to a drill through wing rib telescoping: when a downward push force is desired, an upper wing rib extends out of the tool and a lower wing rib retracts into the tool; when an upward push force is desired, the lower wing rib extends out of the tool and the upper wing rib retracts into the tool; when a clockwise push force is desired, a left wing rib extends out of the tool and a right wing rib retracts into the tool; when a counter-clockwise push force is desired, the right wing rib extends out of the tool and the left wing rib retracts into the tool.

The advantages of the present invention will be further analyzed in combination with the accompanying drawings 2 to 3.

Figure 2:
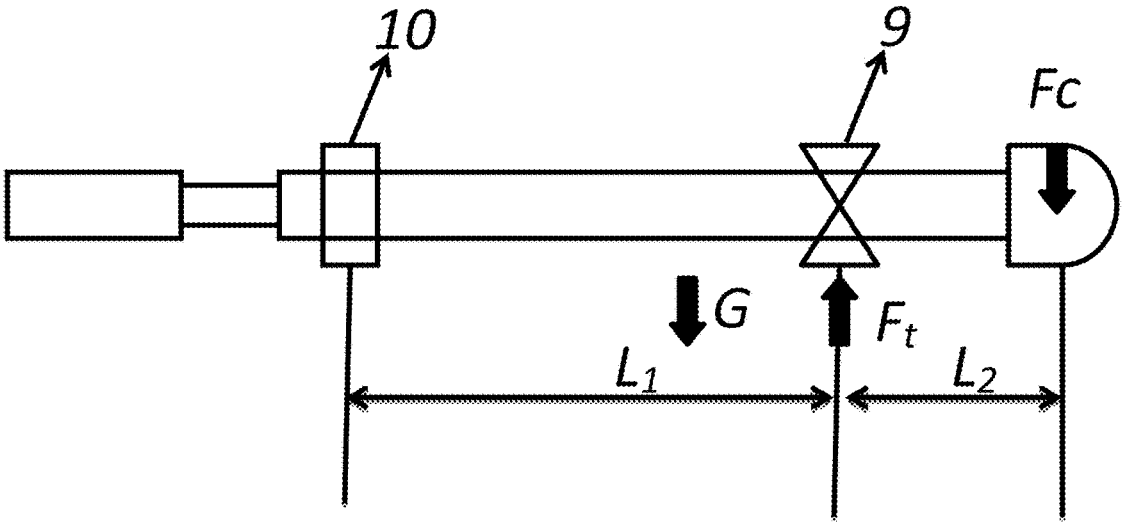
FIG. 2 is a force-receiving analysis diagram of a conventional rotary steering drilling system.
Figure 3:
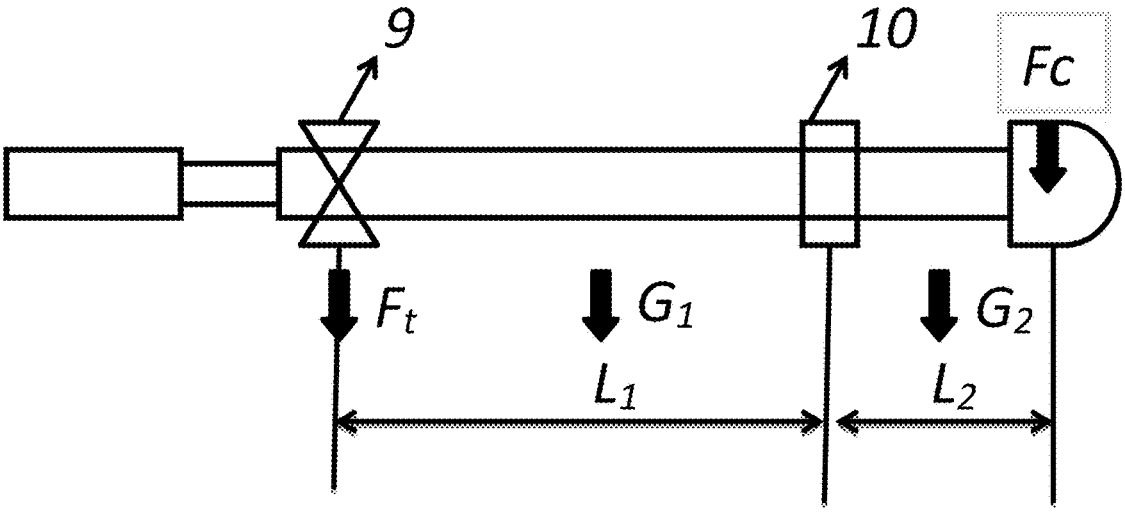
FIG. 3 is a force-receiving analysis diagram of a smart steering drilling system according to the present invention.

FIG. 2 is a force-receiving analysis diagram of a conventional push type rotary steering drilling system. In the conventional push type rotary steering drilling system, the push force application wing rib 9 is disposed close to the drill bit 8, and the ordinary centralizer 10 is disposed away from the drill bit 8. FIG. 3 is a force-receiving analysis diagram of a smart steering drilling system according to the present invention. In the smart steering drilling system according to the present invention, the ordinary centralizer 10 is disposed close to the drill bit 8 and the push force application wing rib 9 is disposed away from the drill bit 8. According to force reception analysis, in the conventional push type rotary steering drilling method, a push force obtained at the drill bit is calculated in the following formula:

$$F_{c1} = \frac{F_t L_1}{(L_1 + L_2)} - \frac{G}{2}$$

In the present invention, a push force at the drill bit is calculated in the following formula:

$$F_{c2} = \frac{F_t L_1}{L_2} + \frac{G_1 L_1}{2L_2} - \frac{G_2}{2}$$

1. When the steering tools output a same push force, comparison of push forces obtained at the drill bit is as follows:

In a case of $F_t$=2 tons, $L_1$=4 meters, $L_2$=1 meter and the drill line density 0.1 tons/meter, thus G=0.5 tons, $G_1$=0.4 tons, and $G_2$=0.1 tons, the push force of the drill bit is calculated:

in the conventional push type rotary steering drilling method, a push force obtained at the drill bit is $F_{c1}$=1.35 tons;

a push force obtained at the drill bit in the present invention is $F_{c2}$=8.75 tons;

The push force obtained at the drill bit in the present invention is 6.48 times that of the conventional push type rotary steering drilling method, that is, when the steering tool applies a same push force, the deflection capability in the steering drilling system and the drilling method of the present invention can be greatly improved.

2. When the drill bit receives a same push force, comparison of the push forces output by the push force application wing rib of the steering tool is as follows:

In a case that the drill bit of the present invention receives a push force $F_{c1}$=1.35 tons, $L_1$=4 meters, $L_2$=1 meter, and the drill line density 0.1 tons/meter, thus G=0.5 tons, $G_1$=0.4 tons and $G_2$=0.1 tons;

the push force output by the push force application wing rib of the present invention is $F_t$=0.1 tons, and the push force to be output by the conventional push type rotary steering drilling method is 2 tons, thus the push force of the present invention is 5% of the existing design. The push force application wing rib will not be easy to wear under small acting force nor easy to enter the formation, which greatly improves the service life of the steering tool, ensuring a drilling pressure transfer effect and increasing the drilling speed.

3. When the push force application wing rib of the steering tool does not output a push force, comparison of the push forces obtained at the drill bit is as follows:

in a case that the push force application wing rib of the present invention outputs a downward push force $F_t$=0 ton, $L_1$=4 meters, $L_2$=1 meter, the drill line density 0.1 tons/meter;

thus, G=0.5 tons, $G_1$=0.4 tons and $G_2$=0.1 tons;

according to calculation, the upward push force received by the drill bit of the present invention is 0.95 tons, which indicates that the drilling system still has strong deflection capability and can perform deflection.

In a case that the push force application wing rib in the conventional push type rotary steering drilling method outputs an upward push force $F_t$=0 ton, $L_1$=4 meters, $L_2$=1 meter, and the drill line density 0.1 tons/meter, thus, G=0.5 tons, $G_1$=0.4 tons and $G_2$=0.1 tons;

according to calculation, the push force received by the drill bit of the conventional push type rotary steering drilling method is −0.25 tons, which indicates that, at this time, the conventional push type rotary steering drilling method cannot perform deflection but may reduce deflection, which is not consistent with the original design intent of the steering drilling system.

In case that the rotary steering telescoping centralizer of the present invention applies a downward push force $F_t$=0 ton, $L_1$=4 meters, $L_2$=1 meter, the drill line density 0.1 tons/meter, thus, G=0.5 tons, $G_1$=0.4 tons, and $G_2$=0.1 tons, according to calculation, the push force received by the drill bit of the present invention is 0.95 tons, which indicates that the drilling system still has strong deflection capability.

Furthermore, the present invention achieves combined deflection under double action of drill bit push and pointing, greatly improving the deflection capability.

Of course, the above descriptions are not intended to limit the present invention and the present invention is not limited to the above embodiments. Any changes, modifications, additions or substitutions made by those skilled in the art within the essence scope of the present invention shall all fall within the scope of protection of the present invention.

The invention claimed is:

1. A high efficiency smart steering drilling system, wherein the steering drilling system is provided with a smart push force application tool and a centralizer, the centralizer is disposed at an end close to a drill bit, the smart push force application tool is disposed at an end away from the drill bit and further provided with a push force application wing rib having a telescoping function, the smart push force application tool is capable of automatically measuring an inclination angle and an azimuth angle and comparing the inclination angle and the azimuth angle with design values so as to control the push force application wing rib to output a push force in a telescopic manner based on a difference between the measured values and the design values and thus achieve the objective of applying a push force to the drill bit; in a case of needing to increase the inclination angle, the push force application wing rib applies a downward push force; in a case of needing to decrease the inclination angle, the push force application wing rib applies an upward push force; in a case of needing to increase the azimuth angle, the push force application wing rib applies a push force toward counterclockwise direction; in a case of needing to decrease the azimuth angle, the push force application wing rib applies a push force toward clockwise direction; a drilling acceleration tool, a near-bit drilling collar and a near-bit measurement sub, or any two of the drilling acceleration tool, the near-bit drilling collar and the near-bit measurement sub, or any one of the drilling acceleration tool, the near-bit drilling collar and the near-bit measurement sub is disposed between the smart push force application tool and the centralizer; the smart push force application tool is composed of a trajectory parameter measuring module, a trajectory correcting module, a push force application control module, and a push force application wing rib, the trajectory parameter measuring module measures borehole trajectory parameters in real time, the trajectory correcting module compares the borehole trajectory parameters measured in real time with design trajectory parameters and provides a trajectory control instruction to the push force application control module, and the push force application control module receives the trajectory control instruction from the trajectory correcting module to control a push force application mode of the push force application wing rib.

2. The high efficiency smart steering drilling system of claim 1, wherein on the smart push force application tool is provided with a flexible joint and an upper drill assembly, and the upper drill assembly, the flexible joint and the smart push force application tool are connected in sequence.

3. The high efficiency smart steering drilling system of claim 1, wherein the centralizer is integrated to a component immediately close to the drill bit.

4. The high efficiency smart steering drilling system of claim 1, wherein the centralizer is an ordinary down-hole packed-hole centralizer or a rotary shell centralizer.

5. The high efficiency smart steering drilling system of claim 1, wherein the push force application mode of the smart push force application tool is to enable the push force application wing rib to apply a push force to a drill through wing rib telescoping: when a downward push force is desired, an upper wing rib extends out of the tool and a lower wing rib retracts into the tool; when an upward push force is desired, the lower wing rib extends out of the tool and the upper wing rib retracts into the tool; when a push force toward clockwise direction is desired, a left wing rib extends out of the tool and a right wing rib retracts into the tool; when a push force toward counterclockwise direction is desired, the right wing rib extends out of the tool and the left wing rib retracts into the tool.

6. A drilling method using the high efficiency smart steering drilling system of claim 1, wherein the drilling system is provided with an upper drill assembly and a flexible joint, and the upper drill assembly, the flexible joint and the smart push force application tool are connected in sequence, and the drilling method comprises the following steps:

at step 1, based on a trajectory control requirements, calculating a length of the flexible joint, a distance from the flexible joint to the push force application wing rib, a distance from the push force application wing rib to the centralizer and a distance from the centralizer to the drill bit;

at step 2, based on data calculated in step 1, assembling the drilling system;

at step 3, according to a designed drilling solution, performing steering drilling operation in the following method:

the smart push force application tool is capable of automatically measuring an inclination angle and an azimuth angle and comparing the measured values with design values so as to control the push force application wing rib to output a push force based on a difference between the measured values and the design values; in a case of needing to increase the inclination angle, the smart push force application tool applies a downward push force; in a case of needing to decrease the inclination angle, the smart push force application tool applies an upward push force; in a case of needing to increase the azimuth angle, the smart push force application tool applies a push force toward counterclockwise direction; in a case of needing to decrease the azimuth angle, the smart push force application tool applies a push force toward clockwise direction.

7. The drilling method of claim 6, wherein the specific workflow of the smart push force application tool in step 3 is as follows: the trajectory parameter measuring module measures borehole trajectory parameters in real time and transmits the trajectory parameters to the trajectory correcting module, the trajectory correcting module compares the borehole trajectory parameters measured by trajectory parameter measuring module in real time with design trajectory parameters and sends a trajectory control instruction, and the push force application control module controls a push force application mode of the push force application wing rib based on the trajectory control instruction sent by the trajectory correcting module, so that, when the trajectory correcting module sends an inclination angle increasing instruction, the push force application control module controls the push force application wing rib to apply a downward push force; when the trajectory correcting module sends an inclination angle decreasing instruction, the push force application control module controls the push force application wing rib to apply an upward push force; when the trajectory correcting module sends an azimuth angle decreasing instruction, the push force application control module controls the push force application wing rib to apply a clockwise push force; when the trajectory correcting module sends an azimuth angle increasing instruction, the push force application control module controls the push force application wing rib to apply a counter-clockwise push force; the push force application wing rib applies a push force to a drill through wing rib telescoping: when a downward push force is desired, an upper wing rib extends out of the tool and a lower wing rib retracts into the tool; when an upward push force is desired, the lower wing rib extends out of the tool and the upper wing rib retracts into the tool; when a push force toward clockwise direction is desired, a left wing rib extends out of the tool and a right wing rib retracts into the tool; when a push force toward counterclockwise direction is desired, the right wing rib extends out of the tool and the left wing rib retracts into the tool.

* * * * *